US006676443B1

(12) United States Patent
Wang

(10) Patent No.: US 6,676,443 B1
(45) Date of Patent: Jan. 13, 2004

(54) ALL METAL SHELL BNC ELECTRICAL CONNECTOR

(75) Inventor: Tsan-Chi Wang, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 10/173,642

(22) Filed: Jun. 19, 2002

(51) Int. Cl.[7] ..... H01R 13/60
(52) U.S. Cl. ..... 439/541.5; 439/188; 439/581
(58) Field of Search ..... 439/541.5, 188, 439/620, 581, 607

(56) References Cited

U.S. PATENT DOCUMENTS 5,215,470 A * 6/1993 Henry et al. ..... 439/63
5,730,621 A * 3/1998 Wang ..... 439/541.5

* cited by examiner

*Primary Examiner*—Ross Gushi
(74) *Attorney, Agent, or Firm*—Troxell Law Office PLLC

(57) ABSTRACT

An all metal shell BNC electrical connector provides a metal shell with at least two locating holes and at least one of the locating holes receives insulators, a spring plate and a conductive plate. A metal jacket urges a resistance against the conductive plate from a receiving groove defined on the shell wall.

14 Claims, 10 Drawing Sheets

ALL METAL SHELL BNC ELECTRICAL CONNECTOR

BACKGROUND OF THE INVENTION

1. Field of the Invention

The present invention relates to a connector for a signal transmission wire, and particularly to a BNC connector, which is associated with a printed circuit board and provides an all metal shell.

2. Description of Related Art

The signal transmission between electric apparatuses is performed by way of a connector associated with transmission wires. The present inventor has invented a connector entitled "DUAL TYPE BNC connector (ADDITION 1)" published in Taiwanese Patent Official Gazette discloses a dual type BNC connector with metal shell. The dual type BNC connector is joined to a circuit board for connecting with another connector. Referring to FIG. 1, the dual type BNC connector has a metal shell 10 and the shell 10 is provided with two parallel locating holes 11, 12 for engaging with two BNC plugs 13, 14. The shell 10 has an insertion part 15 to be inserted into joining holes of the circuit board. The BNC connectors 13, 14 have lead wires 16, 17 thereof exposing at the rear end 18 of the shell 10.

In order to enhance the quality of signal transmitted by the BNC connector, the inventor has discovered during conducting investigation that the quality of signal transmitted by the BNC can be enhanced if the shell 10 at the rear end thereof is attached with a metal cover. Further, the output end of the connector still emits electromagnetic wave to interfere neighboring electronic electromagnetic signals in case of the connector not connecting other connectors. In order to solve the problem of electromagnetic wave interference, the U.S. Pat. No. 5,387,116 owned by the present inventor has disclosed an auto termination BNC T adapter. However, the T adapter is not possible to be inserted into the printed circuit board due to no insert part being provided so that it is not suitable for being a connector engaging with the printed circuit board in case of other signal connectors being connected to the printed circuit board. In order to improve the connector disclosed in the U.S. Pat. No. 5,387,116, the present invention has developed an all metal shell BNC electric connector, which is possible to be inserted into a socket on the printed circuit board directly.

SUMMARY OF THE INVENTION

An object of the present invention is to provide an auto termination PCB mount connector, which has advantages such as simple construct, being easily set up, a lower cost, and conveniently engaging with the printed circuit board.

Another object of the present invention is to an auto termination PCB mount connector, which is possible to reduce the interference resulting from the electromagnetic wave.

BRIEF DESCRIPTION OF THE DRAWINGS

The present invention can be more fully understood by reference to the following description and accompanying drawing, in which.

DETAILED DESCRIPTION OF THE PREFERRED EMBODIMENT

Figure 2:
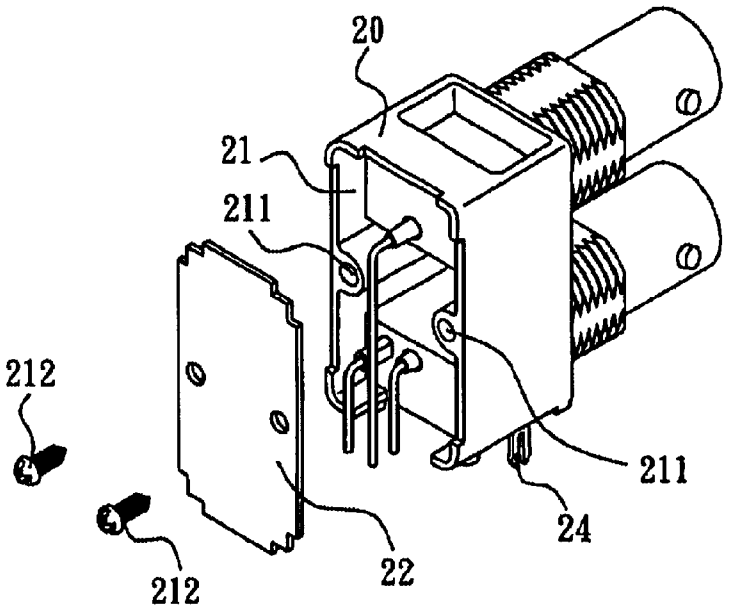
FIG. 2 is an exploded perspective view of a BNC connector according to the present invention.
Figure 1:
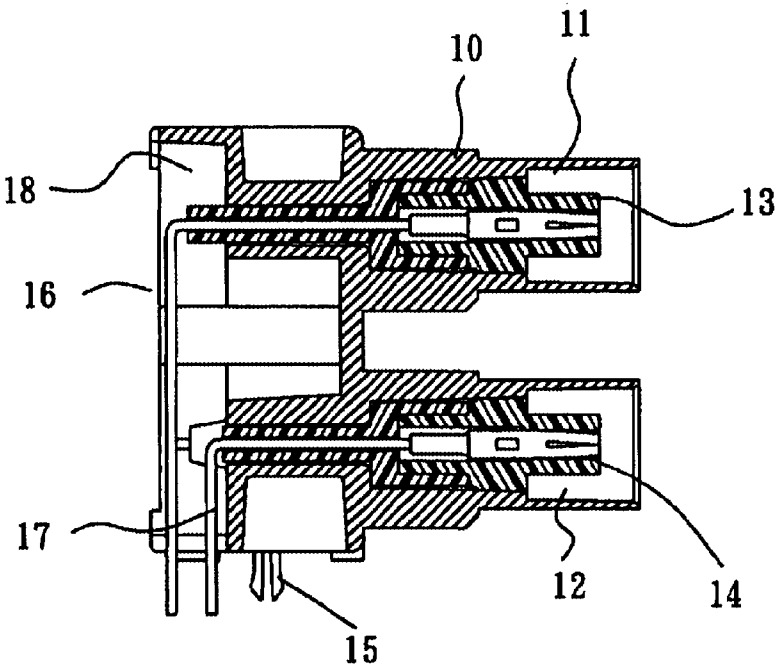
FIG. 1 (PRIOR ART)
FIG. 1 is a sectional view of a conventional dual type BNC connector.
Figure 3:
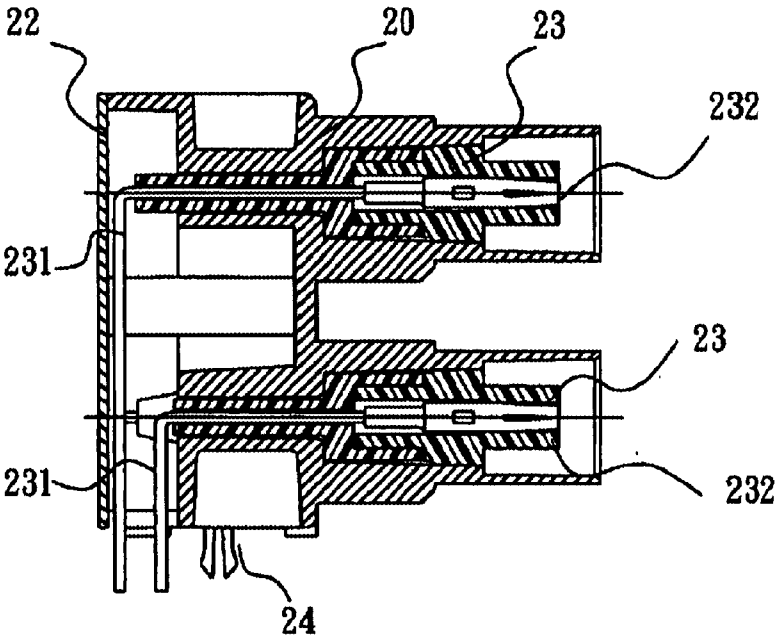
FIG. 3 is a sectional view of the BNC connector shown in FIG. 2.

Referring to FIGS. 2 and 3, a BNC connector of the present invention is different from the conventional dual type BNC connector shown in FIG. 1 in that the BNC connector of the present invention has a metal shell 20 with engaging holes 211 at a rear end 21 thereof for joining with a metal cover 22 by way of screws 212 so that the a BNC plug 23 with lead wires 231 at the rear end thereof is in a space enclosed by the metal shell 20 and the metal cover 22. In this way, the power loss can be reduced during the BNC plug transmitting signals and it is possible to refuse electromagnetic waves emitted from other electronic components outside the BNC connector interfering the signals transmitted by the BNC plug such that signal quality transmitted by the BNC plug can be enhanced effectively. The shell 20 at a direction perpendicular to the BNC plug 23 has double-inverted hook-shaped contact pins 24 for the BNC connector being inserted into the circuit board.

Figure 4:
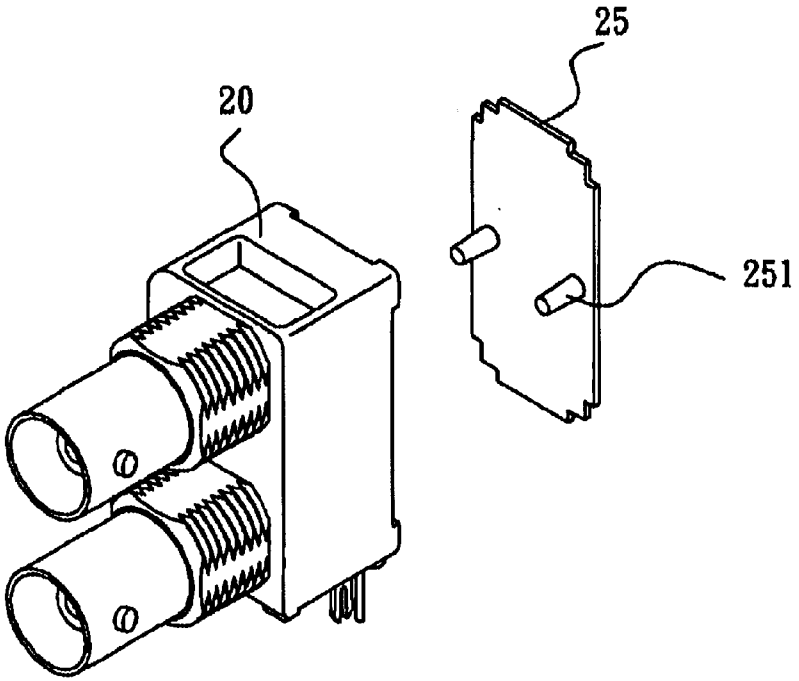
FIG. 4 is an exploded perspective view of a BNC connector according to the present invention in another embodiment thereof.

Referring to FIG. 4, another embodiment of the BNC connector according to the present invention is similar to the BNC connector shown in FIG. 2 and the only difference is that an projection 251 is provided to extend from the metal cover 25 for being inserted into the engaging holes at the bottom of the shell 20 directly instead of screws 212 in FIG. 2.

Figure 5:
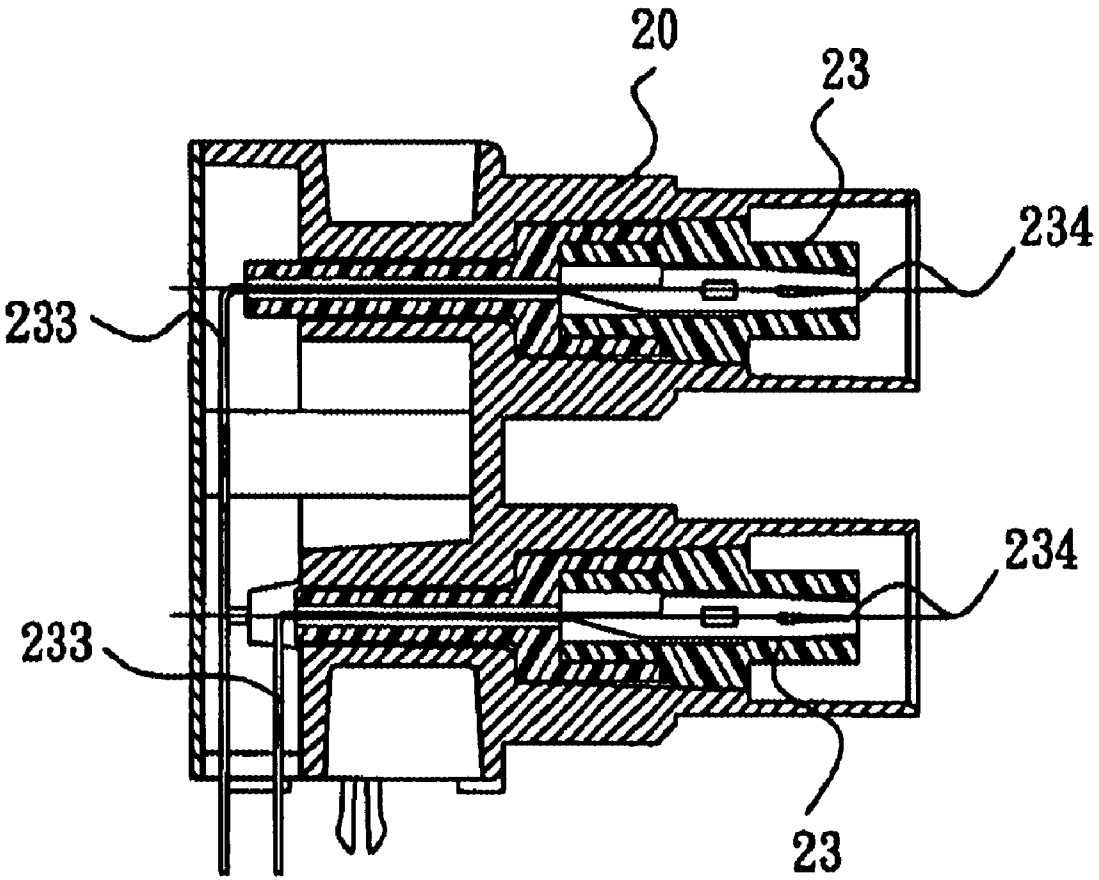
FIG. 5 is a sectional view of a BNC connector according to the present invention in another embodiment thereof.

Referring to FIG. 5, a further embodiment of the BNC connector according to the present invention provides a structure of integral lead wire 233 and terminals 234 instead of individual lead wires 231 and terminals 232 shown in FIG. 3. The lead wire 233 is tube shaped piece made of a sheet plate.

Figure 7:
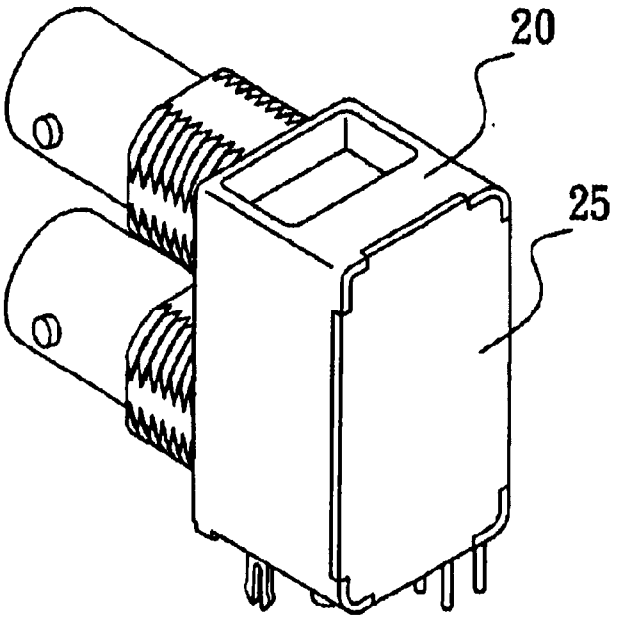
FIG. 7 is an assembled perspective view of the BNC connector shown in FIG. 4.
Figure 6:
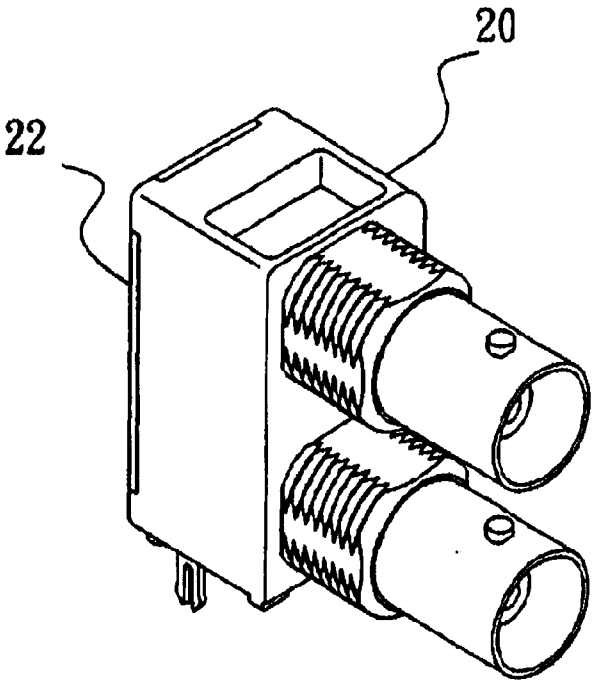
FIG. 6 is an assembled perspective view of the BNC connector shown in FIG. 2.

Referring to FIGS. 6 and 7, the BNC plug with the lead wire at the rear end thereof arranged in the present invention is disposed in a space enclosed by the metal shell 20 and the metal cover 22 or the metal cover 25 to enhance the quality of signal transmitted by the BNC plug.

Figure 8:
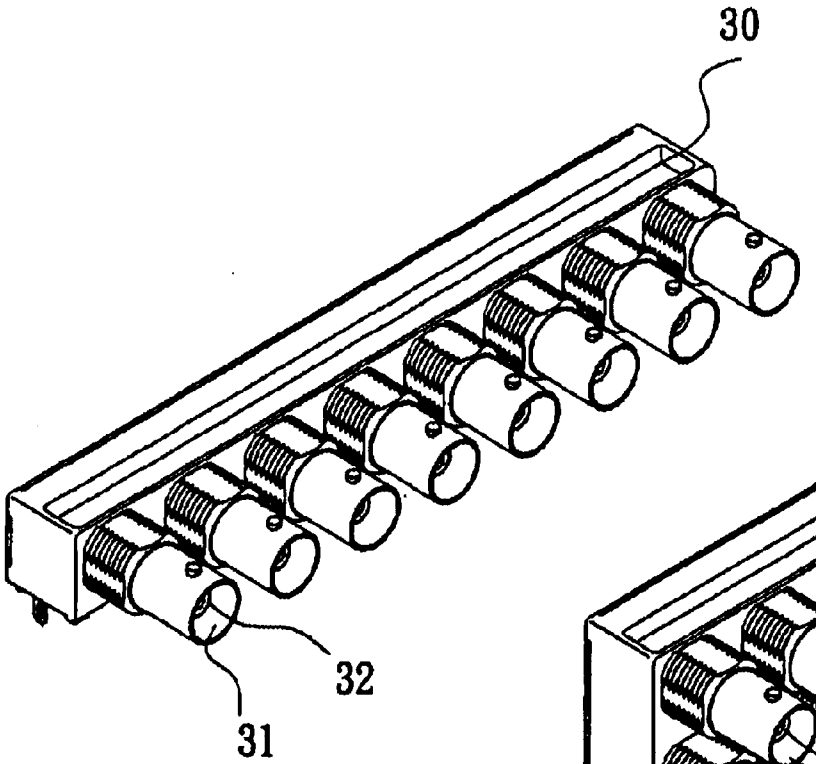
FIG. 8 is a perspective view of a further embodiment of BNC connector according to the present invention.

Referring to FIG. 8, a further embodiment of the BNC connector according to the present invention is arranged to have a plurality of lined up locating holes 31 on the shell 30 and each of the locating holes 31 is associated with the BNC plug 32 respectively.

Figure 9:
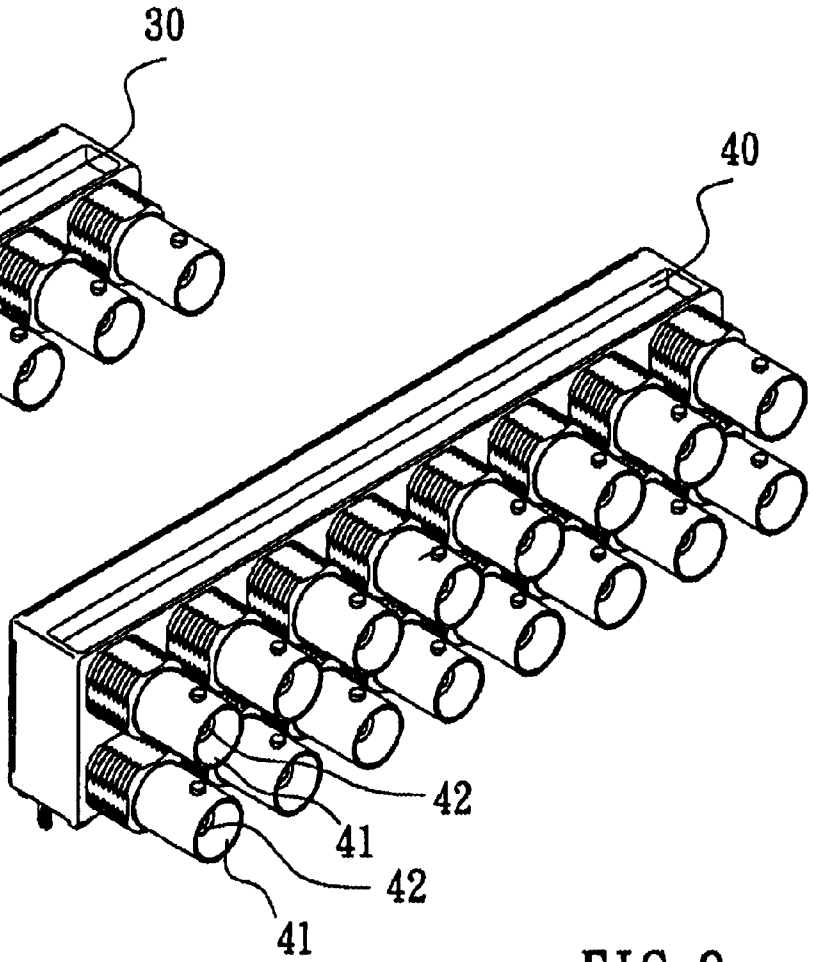
FIG. 9 is perspective view of a further embodiment of BNC connector according to the present invention.

Referring to FIG. 9, a further, embodiment of the BNC connector according to the present invention is arranged to have multiple lines of locating holes 41 on the shell 40 and each of the locating holes 41 is associated with the BNC plug 42 respectively.

Figure 10:
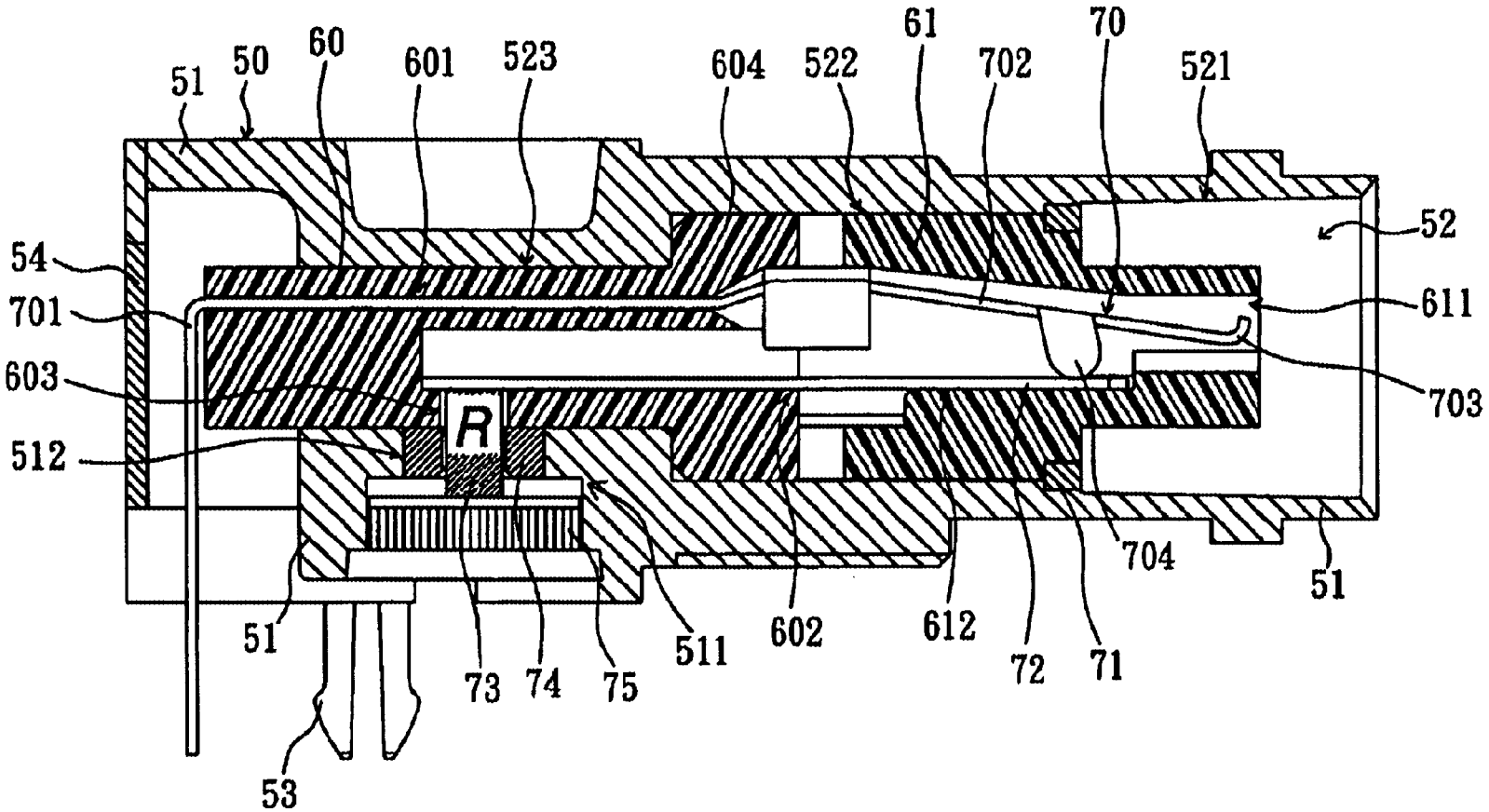
FIG. 10 is a sectional view of an auto termination PCB mount connector according to the present invention in a tenth embodiment thereof.

Referring to FIG. 10, The BNC connector of the present invention can be a connector with automatic termination. The BNC plug with automatic termination has a structure including a rear insulator 60, a front insulator 61, a spring plate 70, a packing ring 71, a conductive plate 72, a resistor 73, an isolator 74 and a metal jacket 75 arranged in the metal shell 50. The metal shell 50 has a shell wall 51 with a locating hole 52 passing through both ends at the inner side thereof. The locating hole 52 is divided into a large hole section 521, a middle hole section 522 and a small hole section 523, sequentially. The shell wall 51 at a part thereof adjacent to the small hole section 523 provides a receiving groove 511 and the receiving groove 511 communicates with a small hole 512 passing through the shell wall 51. The shell wall 51 at the outer side thereof is Joined to a metal fixing element 53 vertically and the shell 50 at the rear end thereof is attached with a metal cover 54. The rear insulator 60 has a first guide groove 601, a second guide groove 602 and a hole 603 with an end thereof having an engaging section 604, which has an outer diameter larger than the rest part of the rear insulator 60. The hole 603 communicates with the second guide groove 602. The front isolator 61 has a pierced hole 611 and a guide groove 612. The spring plate 70 has a tail section 701, a slant section 702 and a touch section 703 with the slant section 702 extending a contact plate 704 and the touch section 703 having an arc bend.

In case of the BNC plug with automatic termination being mounted, the spring plate 70 at the tail section 701 thereof passes through the first guide groove 601 of the rear insulator 60 and extends outward and the conductive plate 72 at an end thereof is arranged to fit with the second guide groove 602. Then, both the slant section 702 and the touch section 703 of the spring plate 72 are received in the pierced hole 611 of the front insulator 61, and the other end of the conductive plate 60 is arranged to fit with the guide groove 612 of the front insulator 61. Next, the rear insulator 60 and the front insulator 61 are inserted into the shell 50 such that an end of the rear insulator 60 can extend through the small hole section 523 and it allows the hole 603 to communicate with the small hole 512 of the shell wall 51 and the engaging section 604 can fit with a lateral side of the middle hole section 522. The front insulator 61 at an end thereof fits with the middle hole section 522 against the engaging section 604, and the other end thereof is received in the large hole section 521. Further, the packing ring 71 is stuffed between the outer wall of the front insulator 61 and the inner wall surface of the shell wall 51 to fix the rear insulator 60 and front insulator 61 in the shell 50. The resistor 73 is inserted into the hole 603 of the rear insulator 60 through the small hole 512 and the insulator 74 with a central through hole fitting with the resistor 73 so as to be disposed in the small hole 512 and keep untouched with the shell wall 51. Finally, the metal jacket 75 is pressed tightly toward the inner side of the shell 50 from the receiving groove 511 of the shell wall 51 to urge the resistor 73 against the conductive plate 72.

While the BNC plug with automatic termination of present invention is in use, the spring plate 70 has the contact plate 704 to keep contact with the conductive plate 72 in a normal state. If an inserting end of any other connector is inserted, the spring plate 70 at the touch section 703 thereof may contact the inserting end right away and the inserting end may prop up both the touch section 703 and the contact plate 704 to keep the contact plate 704 separating from the conductive plate 72. As soon as the inserting end of the other connector is detached, the contact plate 704 of spring plate 70 may spring back to the original position thereof to contact the conductive plate 72 again such that a signal output from the spring plate 70 may be sent back to the grounded line of the printed circuit board through the conductive plate 72, the resistor 73, the metal jacket 75, the metal shell 50, and the metal fixing element 53 so as to constitute a loop automatically. Due to the resistor 73, the loop can provide a better wave filtering function. In this way, the interference problem of the electromagnetic wave resulting from the output signal of the spring plate 70 can be reduced and a less output power loss can be lowered down too.

Figure 11:
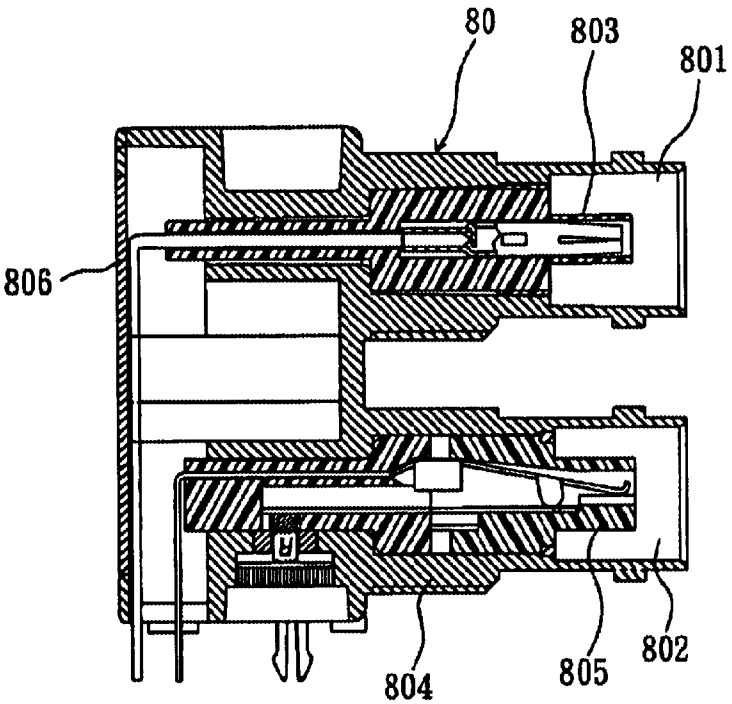
FIG. 11 is a sectional view of a BNC plug with automatic circuit structure.

Referring to FIG. 11, a further embodiment of the BNC connector according to the present invention provides a shell 80 with two locating holes 801, 802. The locating hole 801 is associated with a BNC plug 803 without automatic termination and another locating hole 802 with the shell wall 804 at the lateral side thereof is associated with a BNC plug 805 having automatic termination as the case shown in FIG. 10. The shell 80 at the rear end thereof is associated with a metal cover 806.

Figure 12:
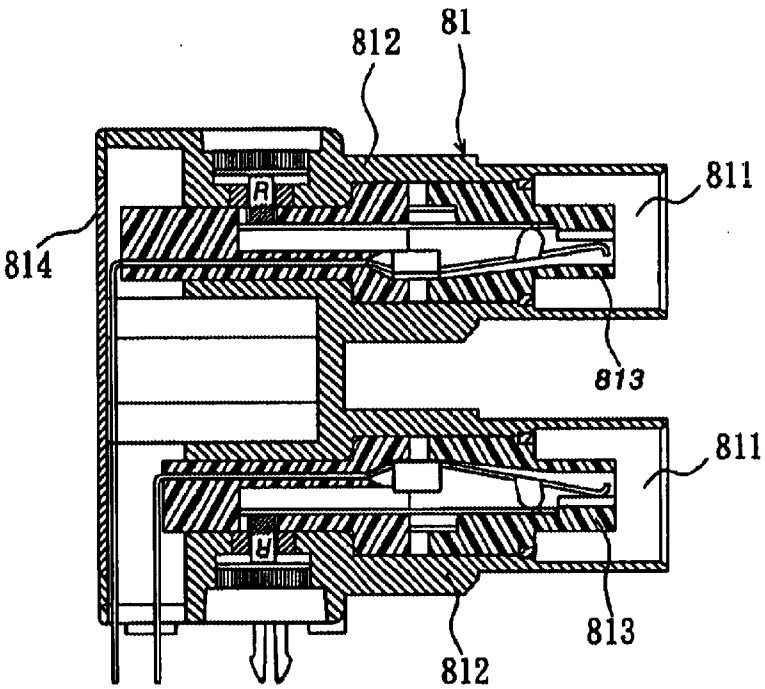
FIG. 12 is a sectional view of a further embodiment of BNC connector according to the present invention.

Referring to FIG. 12, a further embodiment of the BNC connector according to the present invention provides two locating holes 811 and each locating hole 811 with the shell wall 812 at the lateral side thereof is associated with a BNC plug 813 having automatic termination as the case shown in FIG. 10. The shell 81 at the rear end thereof is associated with a metal cover 814.

Figure 15:
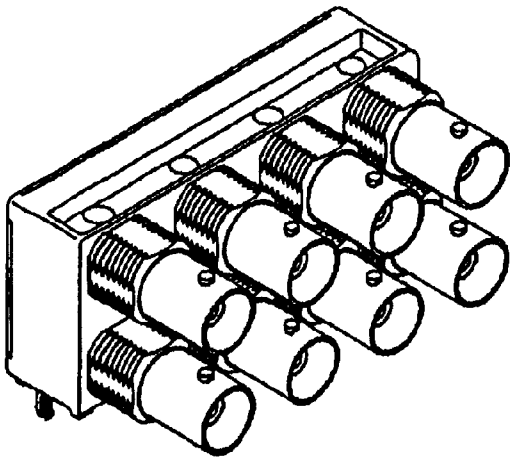
FIG. 15 is a sectional view of a further embodiment of BNC connector according to the present invention.
Figure 13:
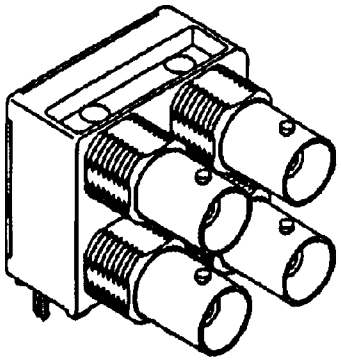
FIG. 13 is a sectional view of a further embodiment of BNC connector according to the present invention.
Figure 14:
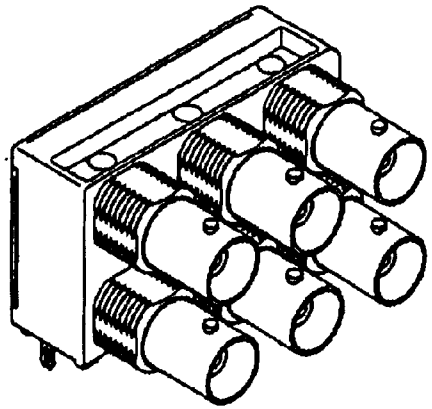
FIG. 14 is a sectional view of a further embodiment of BNC connector according to the present invention.

Referring to FIGS. 13, 14 and 15, further embodiments of the BNC connector according to the present invention provide two, six and eight locating holes on the shell respectively and each locating hole is joined to a BNC plug without automatic termination or a BNC plug with automatic termination.

Figure 17:
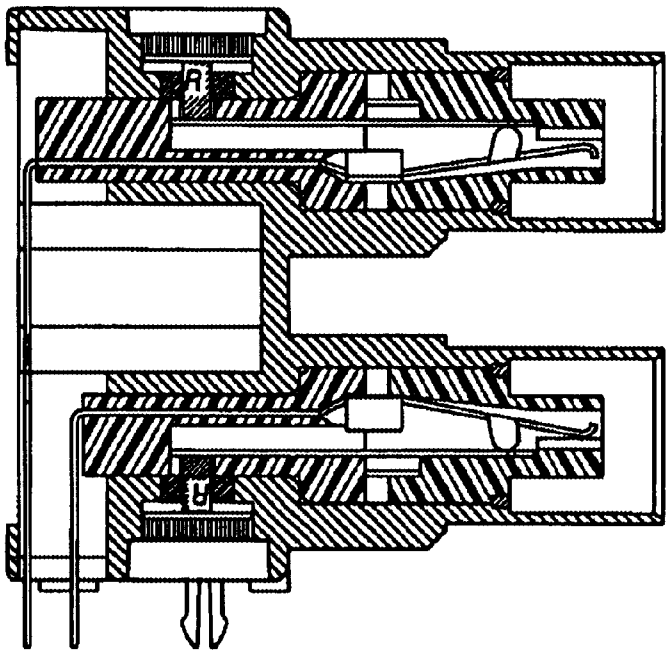
FIG. 17 is a sectional view of a further embodiment of BNC connector according to the present invention;.
Figure 16:
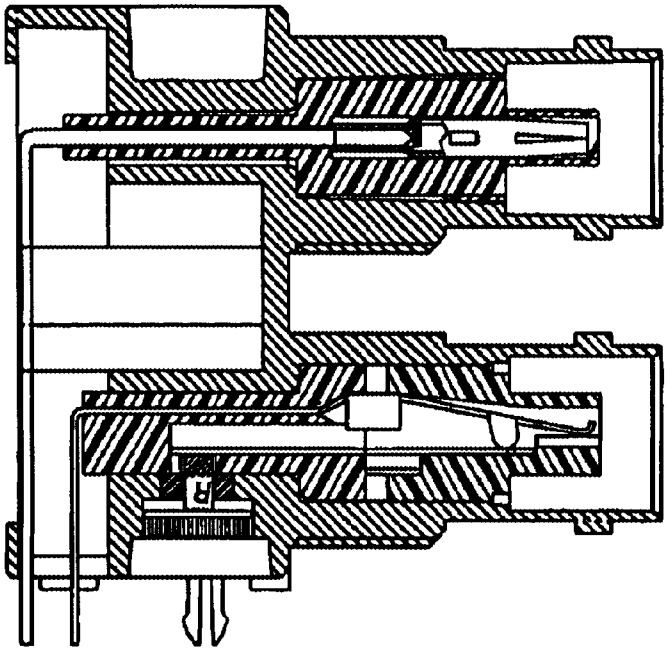
FIG. 16 is a sectional view of a further embodiment of BNC connector according to the present invention.

Referring to FIGS. 16 and 17, two further embodiments of the BNC connector according to the present invention provide the same structures as the BNC connectors shown in FIGS. 11 and 12 except no design of metal covers.

Figure 19:
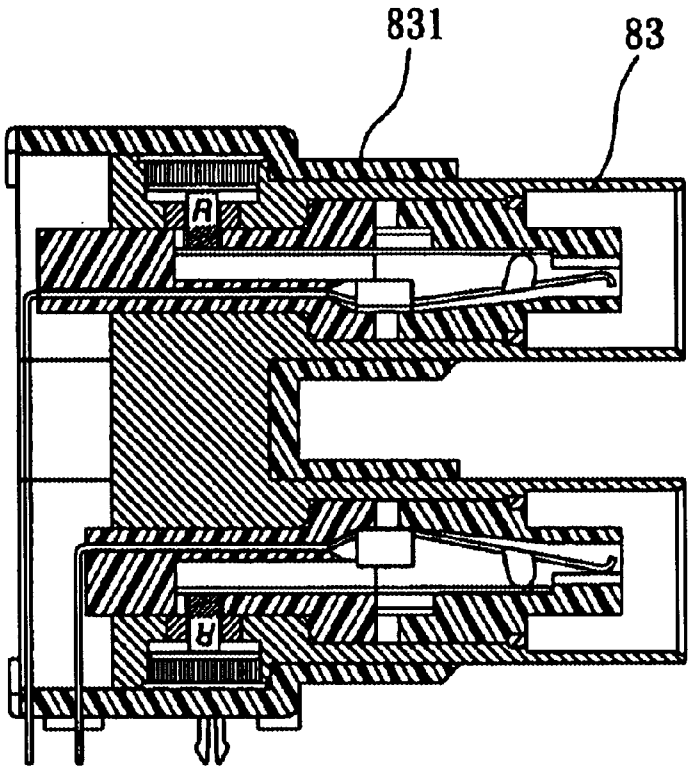
FIG. 19 is a sectional view of a further embodiment of BNC connector according to the present invention.
Figure 18:
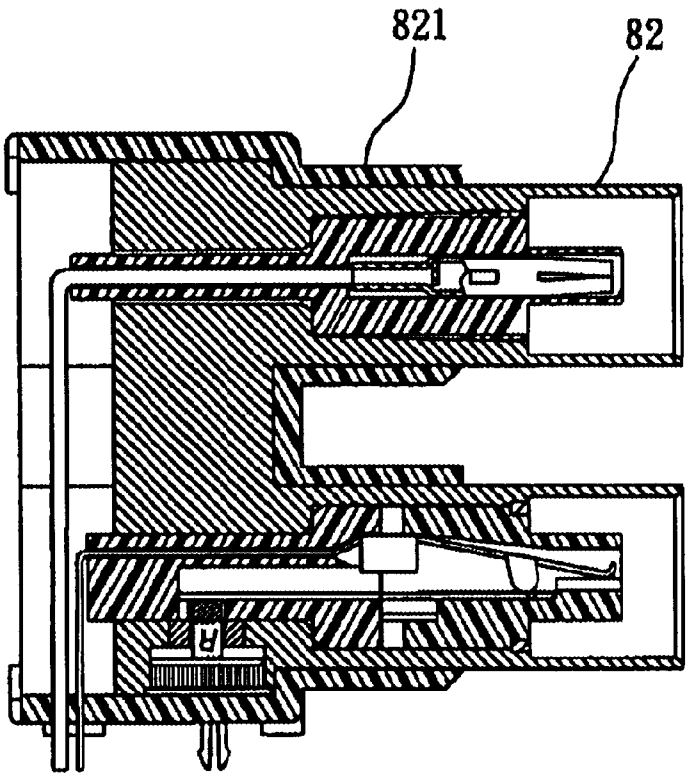
FIG. 18 is a sectional view of a further embodiment of BNC connector according to the present invention.

Referring to FIGS. 18 and 19, two further embodiments of the BNC connector provide structures the same as the BNC connectors shown in FIGS. 16 and 17 except the shells 82, 83 at the outer sides thereof being covered an insulation piece 821, 831 on the rear sections thereof.

It is appreciated that the present invention provides a BNC connector with automatic termination and a rear metal cover, which can be inserted into the a printed circuit board with less parts and easy assembly, so that it is possible to reduce the production cost. Furthermore, the circuit can provide a better wave filtering function by way of the resistance to lower down chance of being interfered by the electromagnetic wave and reduce loss of power output.

While the invention has been described with reference to preferred embodiments thereof, it is to be understood that modifications or variations may be easily made without departing from the spirit of this invention, which is defined by the appended claims.

What is claimed is:

1. A BNC connector with all metal shell, comprising:

a metal shell, being provided with at least two locating holes;

a metal cover, being disposed at a bottom end of the metal shell such that a space can be enclosed by the metal shell and the metal cover; and at least two BNC plugs, being received in the locating holes respectively with a lead wire extending from a rear end of the respective BNC plug and the BNC plugs and the lead wire being arranged in the space, wherein the metal cover extends a projection and the projection is inserted into engaging holes at the bottom end.

2. A BNC connector with all metal shell, comprising:

a metal shell, being provided with at least two locating holes;

a metal cover, being disposed at a bottom end of the metal shell such that a space can be enclosed by the metal shell and the metal cover; and at least two BNC plugs, being received in the locating holes respectively with a lead wire extending from a rear end of the respective BNC plug and the BNC plugs and the lead wire being arranged in the space, wherein the metal cover is engaged to the shell with screws.

3. A BNC connector with all metal shell, comprising:

a metal shell, being provided with at least two locating holes;

a metal cover, being disposed at a bottom end of the metal shell such that a space can be enclosed by the metal shell and the metal cover; and at least two BNC plugs, being received in the locating holes respectively with a lead wire extending from a rear end of the respective BNC plug and the BNC plugs and the lead wire being arranged in the space, wherein the locating hole at least receives a BNC plug with automatic termination and the BNC plus is defined with a rear and a front insulators, a spring plate and a conductive plate being provided in the rear and the front insulators, the spring plate having a tail section, a slant section and a touch section, the slant section extending a contact plate to touch the conductive plate in a normal state, the tail section piercing the rear insulator and extending outward the shell, and the touch section being touched by an insert end of any other connector in case of the insert end being inserted into the spring plate, the touch section being propped up and the contact plate keeping separating from the conductive plate, the contact plate of the spring plate can spring back to an original position thereof to contact with the conductive plate and form automatic termination; the shell wall providing a receiving groove to connect with a small hole piercing the shell wall and the small hole communicating with the hole in the rear insulator; a resistor being received in the receiving groove and passing over the small hole and extending into the hole in the rear insulator; a further insulator, providing a central through hole fitting with the resistor, and being disposed in the small hole to allow the resistor not to contact with the shell; and a metal jacket being placed in the receiving groove to urge an inner side of the shell so as to contact an press the resistor against the conductive plate.

4. A BNC connector with all metal shell, comprising:

a metal shell, being provided with at least two locating holes;

a metal cover, being disposed at a bottom end of the metal shell such that a space can be enclosed by the metal shell and the metal cover; and at least two BNC plugs, being received in the locating holes respectively with a lead wire extending from a rear end of the respective BNC plug and the BNC plugs and the lead wire being arranged in the space, wherein the locating hole receiving the BNC plug with automatic termination has a large hole section, a middle hole section and a small hole section sequentially; the rear insulator has an end thereof extending outward the small hole section; a fixing section with a big outer diameter fitting with a lateral side of the middle hole section and the front insulator at an end thereof fitting with the middle hole section and urging against the fixing section and another end thereof being received in the large hole section; and a packing ring is provided to stuff tightly between an outer wall surface of the front insulator and an inner wall surface of the casing wall to retain the rear insulator and the front insulator in the shell.

5. The BNC connector with all metal shell according to claim 4, wherein at least four said locating holes are provided.

6. The BNC connector with all metal shell according to claim 5, wherein at least eight said locating holes are provided.

7. A BNC connector with all metal shell, comprising:

a metal shell, being provided with at least two locating holes;

a BNC plug, being received in each of the locating holes;

wherein, the locating hole at least receives a BNC plug with automatic termination and the BNC plug is defined with a rear and a front insulators, a spring plate and a conductive plate being provided in the rear and the front insulators, the spring plate having a tail section, a slant section and a touch section, the slant section extending a contact plate to touch the conductive plate in a normal state, the tail section piercing the rear insulator and extending outward the shell, and the touch section being touched by an insert end of any other connector in case of the insert end being inserted into the spring plate, the touch section being propped up and the contact plate keeping separating from the conductive plate, the contact plate of the spring plate can spring back to an original position thereof to contact with the conductive plate and form automatic termination; the shell wall providing a receiving groove to connect with a small hole piercing the shell wall and the small hole communicating with the hole in the rear insulator; a resistor being received in the receiving groove and passing over the small hole and extending into the hole in the rear insulator; a further insulator, providing a central through hole fitting with the resistor, and being disposed in the small hole to allow the resistor not to contact with the shell; and a metal jacket being placed in the receiving groove to urge an inner side of the shell so as to contact and press the resistor against the conductive plate.

8. The BNC connector with all metal shell according to claim 7, wherein the locating hole receiving the BNC plug with automatic termination has a large hole section, a middle hole section and a small hole section sequentially; the rear insulator has an end thereof extending outward the small hole section; a fixing section with a big outer diameter fitting with a lateral side of the middle hole section and the front insulator at an end thereof fitting with the middle hole section and urging against the fixing section and another end thereof being received in the large hole section; and a packing ring is provided to stuff tightly between an outer wall surface of the front insulator and an inner wall surface of the casing wall to retain the rear insulator and the front insulator in the shell.

9. The BNC connector with all metal shell according to claim 8, wherein at least four said locating holes are provided.

10. The BNC connector with all metal shell according to claim 8, wherein at least eight said locating holes are provided.

11. The BNC connector with all metal shell according to claim 8, wherein two locating holes are provided and each of the locating holes receives a BNC plug with automatic termination.

12. The BNC connector with all metal shell according to claim 8, wherein two locating holes are provided and one of the locating holes receives a BNC plug with automatic termination.

13. The BNC connector with all metal shell according to claim 11, wherein the shell at a rear part thereof covers with an insulation casing on the outer side thereof.

14. The BNC connector with all metal shell according to claim 12, wherein the shell at a rear part thereof covers with an insulation casing on the outer side thereof.

* * * * *